US005784940A

United States Patent [19]

Gross et al.

[11] Patent Number: 5,784,940

[45] Date of Patent: Jul. 28, 1998

[54] MACHINE FOR CUTTING FLAT STOCK

[75] Inventors: Helmut Gross, Hofheim; Frank Stemmer, Babenhausen, both of Germany

[73] Assignee: Adolf Mohr Maschinenfabrik GmbH & Co KG, Hofheim am Taunus, Germany

[21] Appl. No.: 615,486

[22] Filed: Mar. 12, 1996

[30] Foreign Application Priority Data

Apr. 3, 1995 [DE] Germany ..... 195 12 106.6

[51] Int. Cl.[6] ..... B26D 1/08; B26D 7/26

[52] U.S. Cl. ..... 83/699.41; 83/640; 83/699.31

[58] Field of Search ..... 83/699.31, 699.41, 83/699.11, 640, 694, 697

[56] References Cited

U.S. PATENT DOCUMENTS

| | | | |
|---|---|---|---|
| 392,362 | 11/1888 | Ridley | 83/699.41 |
| 700,053 | 5/1902 | Kendall | 83/699.41 |
| 848,187 | 3/1907 | Meyers | 83/699.41 X |
| 1,195,538 | 8/1916 | Wadhams | 83/699.31 |
| 1,866,855 | 7/1932 | Kirsten | 83/694 |
| 2,379,740 | 7/1945 | Palmer | 83/699.31 |
| 2,525,401 | 10/1950 | Dehn | 83/699.41 X |
| 3,046,825 | 7/1962 | Thompson | 83/699.11 |
| 3,064,512 | 11/1962 | Zurlo | 83/694 X |
| 3,122,048 | 2/1964 | Warner | 83/699.11 |
| 3,148,575 | 9/1964 | Thyng | 83/699.11 |
| 3,289,517 | 12/1966 | Brombach et al. | 83/699.41 |
| 3,340,758 | 9/1967 | Peterson et al. | 83/699.31 X |
| 3,496,823 | 2/1970 | Kruse | 83/699.11 |
| 3,593,611 | 7/1971 | Sagehorn | 83/697 |
| 4,027,567 | 6/1977 | Jones, Jr. | 83/640 X |
| 5,000,070 | 3/1991 | Ozawa et al. | 83/636 X |
| 5,035,165 | 7/1991 | Madsen | 83/699.31 X |
| 5,121,626 | 6/1992 | Baldwin | 83/699.11 X |

FOREIGN PATENT DOCUMENTS

| | | | |
|---|---|---|---|
| 1275776 A | 10/1961 | France | 83/699.31 |
| 637833 | 11/1936 | Germany | 83/697 |
| 1093327 | 11/1960 | Germany | 83/699.41 |
| 1128836 | 5/1962 | Germany | 83/416 |
| 31475 | 9/1964 | Germany | 83/699.41 |
| 1251271 A | 10/1967 | Germany | 83/699.41 |
| 2921695 | 12/1980 | Germany | 83/697 |
| 881477 | 11/1961 | United Kingdom | 83/699.41 |
| 938279 | 10/1963 | United Kingdom | 83/699.41 |
| 984629 | 3/1965 | United Kingdom | 83/699.41 |

*Primary Examiner*—Eugenia Jones
*Assistant Examiner*—Charles Goodman
*Attorney, Agent, or Firm*—Max Fogiel

[57] ABSTRACT

A machine for cutting flat stock, especially sheets of material. The machine has a counter that accommodates the stock and a cutting assembly. The cutting assembly has a knife mounted on a beam that travels up and down toward and away from the counter in a machinery frame. The beam accommodates at least two separate knife-positioning components that force the back of the knife against the beam. Each knife-positioning component rests against a pressure-accommodating component on the back of the knife. At least that area of the pressure-accommodating component that comes into contact with the knife-positioning component is hard.

15 Claims, 3 Drawing Sheets

MACHINE FOR CUTTING FLAT STOCK

BACKGROUND OF THE INVENTION

The present invention concerns a machine for cutting flat stock, especially sheets of material. It has a counter that accommodates the stock and a cutting assembly. The cutting assembly comprises a knife mounted on a beam that travels up and down toward and away from the counter in a machinery frame. The beam accommodates at least two separated and knife-positioning components that support the back of the knife against the beam.

A wide range of flat-stock cutting machines are known, from European Patent 0 056 874 for example.

Machines of the genus initially described herein are known in practice. The knife is secured to the beam by several screws. The screws screw into threaded bores in the knife and through slots in the beam that extend vertically in relation to the surface of the counter. The knife can accordingly be adjusted on the beam in order to compensate for wear and sharpening. The knife in flat-stock cutting machines wherein the knife can be adjusted in relation to the beam is usually attached to the beam at at least two points in addition to the aforementioned screws. This is usually done either with setscrews that can be screwed in and out parallel to the knife's stroke or with cams that apply force to the back of the knife. There is a drawback in that setscrews and cams tend to dig into the soft back of the knife, which accordingly changes position in relation to the beam. The knife can accordingly be damaged during continuous operation when the back slips out for example, and precise cutting will no longer be possible.

SUMMARY OF THE INVENTION

The object of the present invention is a simple improvement in a machine of the aforesaid genus ensuring that the knife will reliably maintain its position on the beam for a long time.

This object is attained in accordance with the present invention in a machine of the aforesaid genus in that each knife-positioning component rests against a pressure-accommodating component on the back of the knife whereby at least that area of the pressure-accommodating component that comes into contact with the knife-positioning component is hard. Since the hard pressure-accommodating component is a separate component, it will be unnecessary to harden the metal knife as a whole in order to prevent the knife-positioning component from digging into its back. All that is necessary is to satisfactorily harden the contact between the knife-positioning component and the pressure-accommodating component. No such property is necessary between the pressure-accommodating component and the back of the knife, where the pressure is very slight.

The knife-positioning components can be cams or setscrews. They can be of hardened metal. The area of the pressure-accommodating component that comes into contact with the knife-positioning component can also be hard, made of hardened metal for example. The components can basically be of any appropriate materials that are hard enough to withstand considerable pressure. The hardness of the pressure-accommodating component allows the knife to be in two parts, a holder of soft metal and a blade that does the actual cutting. The blade is accommodated in a recess in the holder and hard-soldered to it. The material is accordingly hardened only where necessary to accommodate powerful force or pressure. In other areas less expensive unhardened materials can be employed.

The knife-positioning component in one preferred embodiment of the present invention includes a cam mounted in a practical way on a perpendicular blade-positioning component supporting shaft and accommodated in the knife. The cam can accordingly be rotated relative to the knife beam, varying the position of the knife to the knife beam over a wide range. The circumference of the cam can include a section extending half way around a circle that can be brought into contact with the back of the knife. The axis of the shaft can be positioned off the center of the circle, resulting in an eccentricity that allows maximal displacement as the cam rotates approximately 180°. The cam can of course also rotate farther, up to 300° for example, if it is helical instead of circular. It will basically be sufficient for the cam to rotate relative to the shaft and be stabilized against the back of the knife by the beam. It is, however, of advantage for the cam to be mounted tight on the blade-positioning component supporting shaft. The shaft can in this event be prevented from rotating backward and can be secured axially by a clamp. The cam can alternatively be secured by friction-generating material between it and the beam. The friction-generating material can be in addition to the clamp.

To particularly facilitate operation of the machine, the blade-positioning component supporting shaft should extend through a bore in the knife holder and accordingly be accessible for rotation and positioning by the operator.

It is particularly significant that the pressure-accommodating component is not part of the overall machinery but inserted between the back of the knife and the knife positioning component. The pressure-accommodating component will accordingly always rest optimally against the back of the knife even when it is distorted or not precisely positioned for other reasons. The pressure-accommodating component in one particular embodiment of the present invention is attached to a flat guide positioned between the cam and the beam and extending behind the blade-positioning component supporting shaft. The guide is accordingly secured between the cam and the beam, and its extension behind the shaft ensures that is will be suspended from the shaft when the knife is removed. It will be practical for the blade-positioning component supporting shaft to extend through a slot in the guide. The guide will accordingly be positioned between the cam and the beam in this embodiment and cannot get lost, although it can be displaced along the slot as the cam rotates.

One particular advanced version of the present invention includes a spacer between the pressure-accommodating component and the knife. The spacer is employed when the knife is worn down too far for its back to be far enough away from the beam even when the knife-positioning components have been maximally adjusted. The knife can in his event still be adjusted, depending on the thickness of the spacer. It will be practical for the spacer to be attached to and particularly screwed to the knife.

It will be of advantage for the pressure-accommodating components and spacers to be accommodated only where pressure needs to be distributed. It will also be of advantage for the pressure-accommodating components and spacers or both to be parallelepipedal.

To ensure that the knife is secured to the beam in accordance with the differences in their positions, the beam can have several slots paralleling the displacement of the knife relative to the knife holder, at least one threaded bore in the knife can be associated with each slot, and a setscrew can extend through the bore and the slot. In the event that a spacer is employed to extend the possible displacement of the knife relative to the beam, the knife should have several bores associated with and distributed along each slot. The slots can accordingly be relatively short and the displacement extended by screwing each screw into the bore associated with the particular slot.

Further characteristics of the present invention will be evident from the following specification and from the figures. All characteristics and combinations thereof are essential to the present invention.

BRIEF DESCRIPTION OF THE DRAWINGS

The figures illustrate two embodiments of a machine for cutting flat stock in accordance with the present invention without limiting its scope in any way.

DESCRIPTION OF THE PREFERRED EMBODIMENTS

Figure 1:
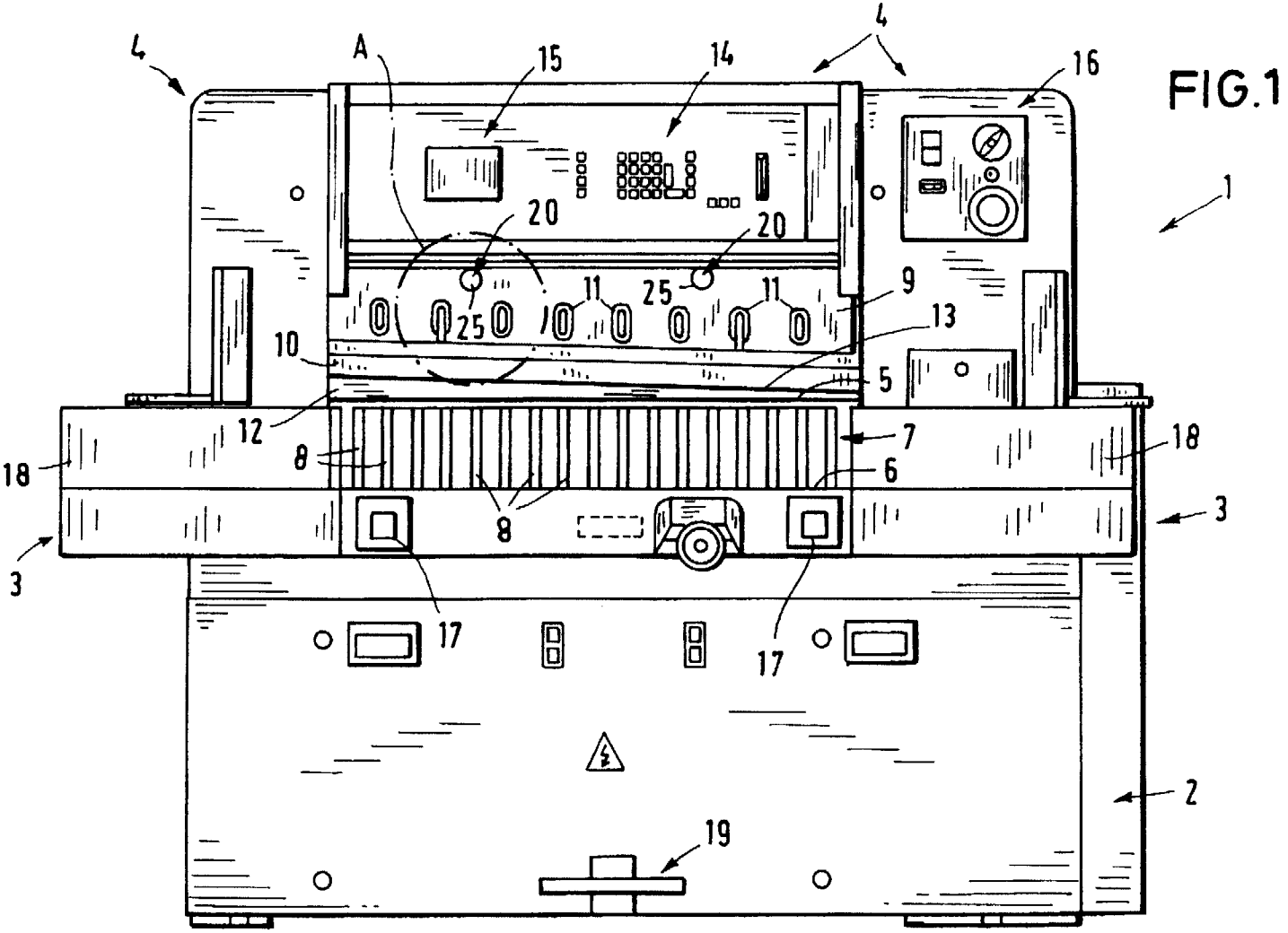
FIG. 1 is a front view of the machine.

The machine 1 for cutting flat stock illustrated in FIG. 1 comprises a base 2 and a counter 3 along with a guillotine 4 that extends over it. The stacks of material to be cut are deposited on the surface 6 of counter 3, perpendicular to the major plane of the material, which is essentially in the form of sheets.

FIG. 1 illustrates machine 1 as seen by the operator.

Accommodated behind guillotine 4 and in counter 3 is a rake-like saddle 7 with prongs 8 that advance the material perpendicular to its major plane. A beam 9 travels up and down, along the major plane of the material, that is, in guillotine 4. Behind beam 9 and with only its lower edge visible is a knife 10 with an edge 13. Knife 10 is screwed to beam 9. Unillustrated screws extend through several vertical slots 11 in beam 9 and into matching threaded bores in knife 10. Behind knife 10 and with only its lower edge visible is a hold-down 12 with a lower surface 5 for securing the material while it is being cut. The lower edges of beam 9 and knife 10 slope toward the surface 6 of counter 3 in FIG. 1 because they are in the process of producing a rocking cut and accordingly come to rest paralleling surface 6 only at their lower dead point. FIG. 1 represents beam 9, knife 10, and hold-down 12 lifted.

Also illustrated in FIG. 1 is a data-input pad 14, a display screen 15, a switch 16, pushbuttons 17, a pedal 19 for initiating the cut, and lateral baffles 18.

As will be evident from FIG. 1, machine 1 has in the vicinity of beam 9 two horizontally separated knife-positioning components 20. Two versions of such a component are illustrated in FIGS. 2 through 5.

Figure 2:
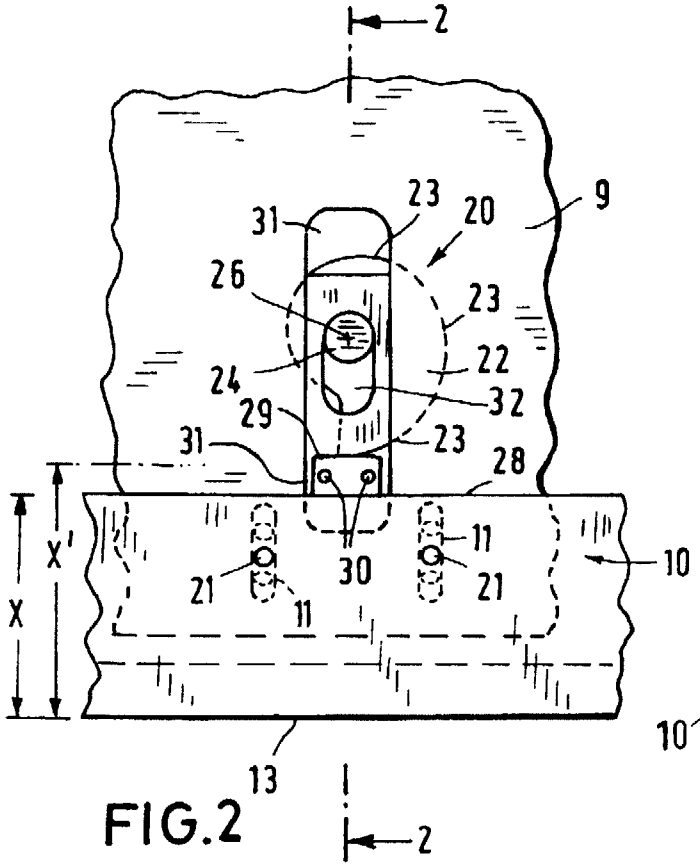
FIG. 2 is a detail of the area A in FIG. 1, illustrating one version of how the knife can be suspended.
Figure 3:
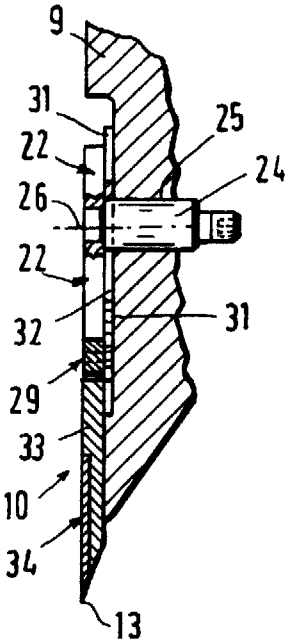
FIG. 3 is a section along the line B B in FIG. 2.

FIG. 2 illustrates how knife 10 is attached to beam 9 in the vicinity of two slots 11 in beam 9. Each slot 11 has a screw 21, only the threaded section of which is illustrated, extending through it from the front. Each screw screws into a matching threaded bore in knife 10. Since slots 11 are vertical in relation to the surface 6 of counter 3, it is possible to vary the distance between the lower edge 13 of the knife and surface 6 without moving beam 9. Knife-positioning components 20 can maintain knife 10 in any desired position. A cam 22 is provided for this purpose. As will be evident from FIGS. 2 and 3, one section 23 of the circumference of cam 22 extends in the form of a helix around an angle of approximately 300°. A perpendicular blade-positioning component supporting shaft 24 extends tightly through cam 22 and loosely through horizontal bore 25 in beam 9. The helix curves around the axis 26 of shaft 24. Shaft 24 is force fit to cam 22 by a square section that matches an opening in the cam.

Between cam 22 and the back 28 of knife 10 is a parallelepipedal pressure-accommodating component 29 of hard metal. Pressure-accommodating component 29 is fastened to a flat guide 31 by two screws 30. Guide 31 extends vertically with its lower end accommodating pressure-accommodating component 29. The guide has an axially parallel slot 32 in the center. Guide 31 is positioned between cam 22 and beam 9, with shaft 24 extending through slot 32.

Figure 4:
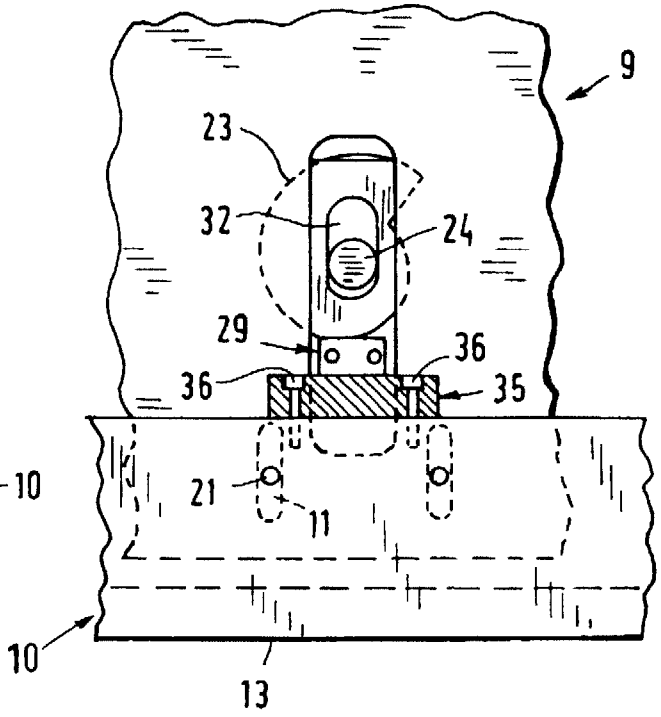
FIG. 4 illustrates how the knife illustrated in FIG. 2 is suspended with a spacer.

The materials employed in the vicinity of knife 10 will now be specified. Cam 22 and pressure-accommodating component 29 are hardened steel, allowing accommodation of the pressure deriving from the linearity of the contact between them. Due to the relatively low pressure between pressure-accommodating components 29 and the back 28 of knife 10, the knife is in two parts. It comprises in a known way a holder 33 and a blade 34. Holder 33 is of non-hardened steel and incorporates back 28. Blade 34 is of hardened steel and does the actual cutting and incorporates edge 13. The blade fits into a recess in holder 33, to which it is hard-soldered. Knife 10 can be reground in accordance with the vertical breadth of blade 34, in which case the vertical breadth of the knife itself will decrease. A machine for cutting flat stock with a blade-positioning component in accordance with the present invention allows precise positioning of even a completely ground-down knife 10 due to the separated cams 22. FIG. 2 illustrates the height x' of a new knife 10. When knife 10 is fresh, cam 22 will be rotated about 180° out of the position illustrated in FIG. 2, and its circumference section 23 will be in contact with pressure-accommodating component 29. When knife 10 wears down, it will be removed from beam 9, while pressure-accommodating component 29 remains freely but securely suspended from beam 9 by way of the guide 31 in associated blade-positioning component supporting shaft 24. Once knife 10 has been sharpened, it will be attached to beam 9 by screws 21, and both cams 22 will be rotated and adjusted in relation to pressure-accommodating components 29 such that the edge 13 of knife 10 can penetrate slightly into an unillustrated cutting strip in counter 3 when beam 9 is at its lower dead point. Screws 21 are then tightened. As will be evident from FIG. 2, the supporting action of cam 22 will be in effect as long as the breadth of knife 10 at least equals dimension x. To allow use of a knife 10 that has been ground down beyond that point, a parallelepipedal spacer 35 of non-hardened metal is, as illustrated in FIG. 4, fastened by several screws 36 to holder 33 in the vicinity of the back 28 of knife 10. As will be evident from the figure, cam 22 will be able to execute its entire stroke again as long as there is a spacer 35 between pressure-accommodating component 29 and knife 10. Although screws 21 will be approximately at the top of slots 11 while knife 10 is fresh, they will be approximately at the middle once cams 22 have rotated all the way without the spacer and at the bottom once the cams have rotated all the way in the presence of a spacer 35.

Slots 11 can be shorter if more threaded bores 21 are provided along them in knife 10, allowing different bores to be employed depending on the breadth of knife 10. Every slot 32 in each guide 31 will be long enough to allow a shaft 24 through when the slot is off center.

Figure 5:
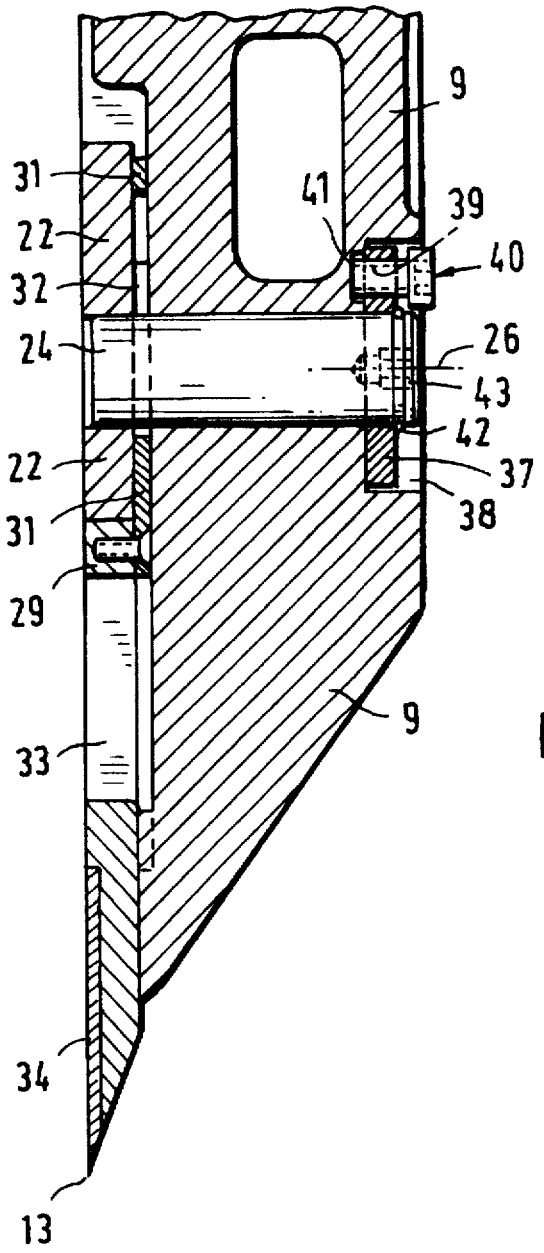
FIG. 5 is a section illustrating another version of how the knife can be suspended in the embodiment illustrated in FIG. 3.
Figure 6:
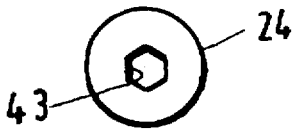
FIG. 6 is an end view of a shaft shown in FIG. 5.

The cam 22 in the embodiment illustrated in FIG. 5 is crimped onto the rear end of blade-positioning component supporting shaft 24. Shaft 24 extends through the bore 25 in beam 9 and can be fastened at the front, the section remote from its associated cam 22, by a clamping plate 37. Clamping plate 37 has a cutout 38 in beam 9 and a bore that is slightly wider than the outside diameter of shaft 24. Clamping plate 37 has a threaded bore 39 paralleling the axis 26 of shaft 24. Bore 39 accommodates a screw 40. The shaft of screw 40 extends through a bore 41 that itself extends part-way through beam 9. As screw 40 screws into bore 41, clamping plate 37 will tilt slightly and secure its associated shaft 24 both axial and rotationally. To prevent clamping plate 37 from getting lost while shaft 24 is not secure, the front of the shaft has a safety ring 42. To allow rotation of each shaft 24 and hence of its associated cam 22, the shaft has a hexagonal depression 43 facing the operator that will accommodate a hexagonal-headed key.

We claim:

1. A machine for cutting flat stock and sheets of material, comprising: a counter for receiving said stock; cutting means having a knife with a cutting edge and a back opposite said cutting edge; a beam for mounting said knife; a machinery frame, said beam traveling up and down toward and away from said counter in said machinery frame; said beam having at least two separate knife-positioning elements for positioning said knife relative to said beam and supporting said knife; pressure receiving means on said back of said knife; said pressure receiving means having at least a hard area in contact with each of said knife-positioning elements, the remaining area of said receiving means being soft relative to said hard area; said knife-positioning elements having a cam resting against said pressure receiving means; a supporting shaft in said beam for supporting said knife-positioning elements and for mounting said cam; said shaft having a front side and a rear side opposite said front side; a flat guide positioned between said cam and said beam and engaging said rear side of said supporting shaft, said pressure receiving means being attached to said flat guide between said cam and said back of said knife for easy replacement of said knife, said pressure receiving means remaining in position when said knife is separated from said beam, said pressure receiving means being positioned in operative position between the back of said knife and said cam, so that said pressure-receiving means lies always against the back of said knife even when said pressure receiving means has a position differing from a specific pre-selected position; said knife being held in position relative to said beam for preventing said knife-positioning elements from digging into the back of said knife.

2. A machine as defined in claim 1, wherein said cam has a circumference with a section contacting said pressure receiving means.

3. A machine as defined in claim 1, wherein said cam is fixed to said supporting shaft.

4. A machine as defined in claim 1, wherein said rear side of said supporting shaft extends through a slot in said flat guide.

5. A machine as defined in claim 1, wherein said cam has a hardened area contacting said pressure receiving means.

6. A machine as defined in claim 1, including a clamping plate for preventing said supporting shaft from rotating and being axially displaced.

7. A machine as defined in claim 1, wherein said knife has a metal holder fastened to said beam; said knife having a metal blade fastened to said holder.

8. A machine as defined in claim 7, wherein said beam has a plurality of slots parallel to displacement of said knife relative to said beam; at least one threaded bore in said knife associated with each slot; and a screw extending through said threaded bore and said slot.

9. A machine as defined in claim 1, wherein said knife has a plurality of threaded bores distributed along each of said slots.

10. A machine as defined in claim 1, wherein said hardened area of said pressure receiving means is metallic at least where contacting said knife-positioning elements.

11. A machine as defined in claim 10, wherein said supporting shaft extends through a bore in said beam.

12. A machine as defined in claim 1, including a spacer between said pressure receiving means and said knife, said spacer being attached to said knife.

13. A machine as defined in claim 12, wherein said spacer is attached to said knife by threaded screw means.

14. A machine as defined in claim 12, wherein said pressure receiving means and said spacer have a parallelpiped-shape.

15. A machine for cutting flat stock and sheets of material, comprising: a counter for receiving said stock; cutting means having a knife with a cutting edge and a back opposite said cutting edge; a beam for mounting said knife; a machinery frame, said beam traveling up and down toward and away from said counter in said machinery frame; said beam having at least two separate knife-positioning elements for positioning said knife relative to said beam and supporting said knife; pressure receiving means on said back of said knife; said pressure receiving means having at least a hard area in contact with each of said knife-positioning elements, the remaining area of said receiving means being soft relative to said hard area; said knife-positioning elements having a cam resting against said pressure receiving means; a supporting shaft in said beam for supporting said knife-positioning elements and for mounting said cam; said shaft having a front side and a rear side opposite said front side; a flat guide positioned between said cam and said beam and engaging said rear side of said supporting shaft, said pressure receiving means being attached to said flat guide between said cam and said back of said knife for easy replacement of said knife, said pressure receiving means remaining in position when said knife is separated from said beam, said pressure receiving means being positioned in operative position between the back of said knife and said cam, so that said pressure-receiving means lies always against the back of said knife even when said pressure receiving means has a position differing from a specific pre-selected position; said knife being held in position relative to said beam for preventing said knife-positioning elements from digging into the back of said knife; said cam having a circumference with a section contacting said pressure receiving means; said cam being fixed to said supporting shaft; said rear side of said supporting shaft extending through a slot in said flat guide; a metal holder fastened to said beam; said knife having a metal blade fastened to said holder; said cam having a hardened area contacting said pressure receiving means; said hardened area of said pressure receiving means being at least where contacting said knife-positioning elements; a clamping plate for preventing said supporting shaft from rotating and being axially displaced; said supporting shaft extending through a bore in said beam; a spacer between said pressure receiving means and said knife; said spacer being attached to said knife; said spacer being attached to said knife by threaded screw means; said pressure receiving means and said spacer having a parallelpiped-shape; said beam having a plurality of slots parallel to displacement of said knife relative to said beam; at least one threaded bore in said knife associated with each slot of said beam; a screw extending through said threaded bore and said slot said associated slot; said knife having a plurality of threaded bores distributed along each of said associated slots.

* * * * *